US008646899B2

(12) United States Patent
Gellida et al.

(10) Patent No.: US 8,646,899 B2
(45) Date of Patent: Feb. 11, 2014

(54) METHODS AND APPARATUS FOR INK DRYING

(75) Inventors: Francisco Javier Perez Gellida, Sant Cugat del Valles (ES); Jesus Ruiz Lluch, Barcelona (ES); Emilio Angulo Navarro, Barcelona (ES); Ezequiel Jordi Rufes Bernard, Sant Feliu de Llobregat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 472 days.

(21) Appl. No.: 12/790,073

(22) Filed: May 28, 2010

(65) Prior Publication Data

US 2011/0292144 A1 Dec. 1, 2011

(51) Int. Cl.
*B41J 2/01* (2006.01)

(52) U.S. Cl.
USPC ..... 347/102

(58) Field of Classification Search
USPC ..... 347/102; 219/216, 674; 346/25; 400/648; 399/69, 336; 392/301; 432/59
See application file for complete search history.

(56) References Cited

U.S. PATENT DOCUMENTS

| | | | | |
|---|---|---|---|---|
| 3,934,112 | A * | 1/1976 | Lakhani | 219/216 |
| 4,075,455 | A * | 2/1978 | Kitamura et al. | 219/216 |
| 4,947,193 | A | 8/1990 | Deshpande | |
| 4,970,528 | A * | 11/1990 | Beaufort et al. | 346/25 |
| 4,981,433 | A * | 1/1991 | Matsumoto et al. | 432/59 |
| 6,244,700 | B1 | 6/2001 | Kimura et al. | |
| 6,305,796 | B1 | 10/2001 | Szlucha et al. | |
| 6,397,488 | B1 | 6/2002 | Brinkly | |
| 6,406,140 | B1 | 6/2002 | Wotton et al. | |
| 6,882,807 | B2 * | 4/2005 | Sakagami | 399/69 |
| 2002/0031389 | A1 * | 3/2002 | Wotton et al. | 400/648 |
| 2004/0149709 | A1 * | 8/2004 | Mori et al. | 219/216 |
| 2004/0238531 | A1 * | 12/2004 | Kikuchi et al. | 219/674 |
| 2006/0291926 | A1 * | 12/2006 | Iwaishi et al. | 399/336 |
| 2007/0133960 | A1 * | 6/2007 | Vinegar et al. | 392/301 |

FOREIGN PATENT DOCUMENTS

EP 0997301 A2 3/2000

OTHER PUBLICATIONS

"Tubular Heaters" Tempco Catalog. Section 10. Rev. 1. Sep. 2009. (http://www.tempco.com/Tempco/Section10.pdf).*
"Flexible Heaters" Tempco Catalog. Section 9. Rev. 1. Jan. 2010. (http://www.tempco.com/Tempco/Section9.pdf).*
"Warming Ideas: Heating Elements: the core of heat and energy production," Zoppas Industries, retrieved from http://portal.zigroup.net/docsites/catalogs/ZI_RICA Plastics_Uk.pd, on Mar. 23, 2006, 36 pages.

* cited by examiner

*Primary Examiner* — Stephen Meier
*Assistant Examiner* — Carlos A Martinez

(57) ABSTRACT

Ink drying methods and apparatus are disclosed. One example ink drying apparatus includes a resistive heating element having a first power dissipation density adjacent to a center region of a print media travel path and a second power dissipation density adjacent to an edge region of the print media travel path, wherein the first and second power densities are not equal.

18 Claims, 4 Drawing Sheets

METHODS AND APPARATUS FOR INK DRYING

BACKGROUND

While some printing inks air dry or dry without the use of heat, some other types of printing inks may bleed or diffuse over the print substrate if they do not dry quickly and may reduce print quality. Thus, some of these inks are subjected to heat to speed the drying process to maintain print quality.

DETAILED DESCRIPTION

Certain examples are shown in the above-identified figures and described in detail below. Several examples are described throughout this specification. The figures are not necessarily to scale and certain features and certain views of the figures may be shown exaggerated in scale or in schematic for clarity and/or conciseness. Although the following discloses example methods and apparatus, it should be noted that such methods and apparatus are merely illustrative and should not be considered as limiting the scope of this disclosure.

The example methods and apparatus described herein may be used to apply heat to dry inks deposited on a print substrate in a large format printer. Some described example ink drying apparatus include a resistive wire having multiple resistive portions. The resistive portions are positioned adjacent to respective ones of edge regions and a center region of an ink drying area of the printer. In some examples, the resistive portions adjacent the edge regions have a higher power dissipation density (e.g., resistivity) than the resistive portion adjacent the center region. The resistive wire may be configured to have different power dissipation densities along its length by using different materials having different resistivities in the different regions or portions of the wire and/or by having different lengths of the resistive wire in the different regions. Accordingly, as used herein, power dissipation density may refer to the power dissipation per unit length of the resistive wire and/or may refer to the power dissipation per unit length of the ink drying area.

Some example methods described herein include applying ink to a print substrate traveling through a print area in a first direction and moving the print media to an ink drying location or area located after the print area in the first direction. The print drying area includes a center region and first and second edge regions. The example methods further include heating a first portion of a resistive element adjacent the center region at a first power density, heating a second portion of the resistive element adjacent the first edge region at a second power density greater than the first power density, and heating a third portion of the resistive element adjacent the second edge region at the second power density or a third power density.

In contrast to known ink drying apparatus, the example methods and apparatus described herein use a smaller printer footprint (floor area) and apply a substantially constant temperature over the ink drying area. Decreasing the size of the printer footprint may result in reduced manufacturing and/or other costs associated with making, using, and/or maintaining the printer, and/or may increase sales of printers by increasing the number of customers that may purchase the printer to fit within a limited operating space.

Figure 1:
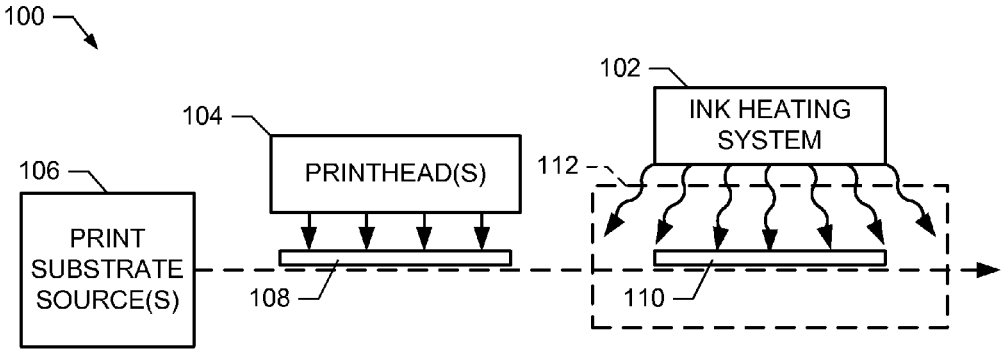
FIG. 1 is a block diagram of an example large format printer including an ink drying system in accordance with the teachings described herein.

FIG. 1 is a block diagram of an example large format printer 100 including an ink heating system 102. The printer 100 further includes one or more print substrate source(s) 106 (e.g., sheet feeders, roll feeders) to feed print substrate(s) 108 and 110 (e.g., printer paper and/or other print media) to printhead(s) 104 for application of ink.

The print substrate(s) 108 and 110 are directed from the print substrate source(s) to the printhead(s) 104, which apply one or more layer(s) of ink to the print substrate(s) 108 and 110. After having ink applied, the print substrate 110 moves to an ink drying area 112 adjacent the ink drying apparatus 102. The example ink drying apparatus 102 applies heat to the ink on the print substrate 110 at a substantially constant temperature to dry the ink. After the ink dries, the print substrate 110 is directed out of the ink drying area 112 and the print substrate 108 may be directed into the ink drying area 112.

Figure 2:
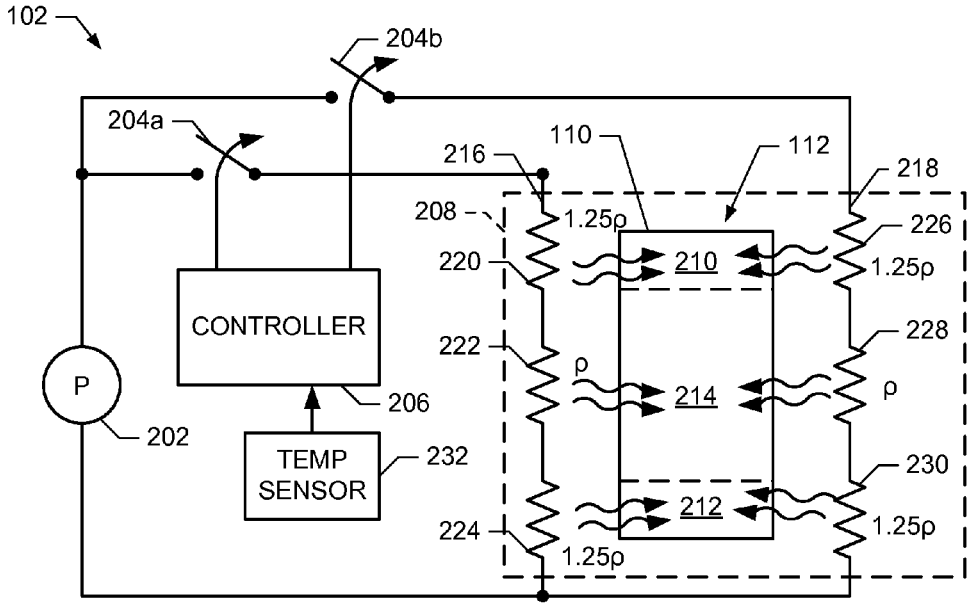
FIG. 2 is a schematic diagram of the example ink drying system of FIG. 1 including a resistive element.

FIG. 2 is a schematic diagram of the example ink heating system 102 of FIG. 1. The example ink heating system 102 includes an energy or power source (e.g., a voltage source, a current source) 202, switching devices 204*a* and 204*b*, a controller 206, and a resistive heating element 208. The resistive heating element 208 is located adjacent the ink drying area 112 of FIG. 1 to apply heat to the print substrate 110. In general, the ink drying area 112 may be divided into three portions: first and second edge regions 210 and 212 and a center region 214. The edge regions 210 and 212 are the lateral end portions of the ink drying area 112 and/or the print substrate 110 in a direction of print travel. These edge regions 210 and 212 may be subject to changes in temperature due to their relative proximities to non-heated portions of the printer 100. The center region 214 is generally defined as the portion of the ink drying area 112 located between the edge regions 210 and 212. The width of the center region 214 may change based on the upper width limit of the printer 100 and/or the print substrates 108 and 110 used by the printer 100. However, the widths of the edge regions 210 and 212 may be substantially constant, given a similar structure of the printer 100, because the edge regions 210 and 212 are proximate to similar external non-heated structures and/or spaces of the printer 100. However, in some examples the edge regions 210 and 212 may be larger or smaller, proportionally or in absolute measurements.

The example resistive heating element 208 includes two resistive wires 216 and 218. The resistive wires 216 and 218 are each shown as several resistors in series to illustrate different regions or portions of the respective resistive wires 216 and 218. In particular, the resistive wire 216 includes three resistive portions 220, 222, and 224 and the resistive wire 218 includes three resistive portions 226, 228, and 230. The resistive portions 220 and 226 are generally adjacent the first edge region 210, the resistive portions 224 and 230 are generally adjacent the second edge region 212, and the resistive portions 222 and 228 are generally adjacent the center region 214. While the example resistive heating element 208 is shown having two resistive wires 216 and 218, the resistive heating element 208 may have one resistive wire or more than two resistive wires.

As illustrated in FIG. 2, the resistive portions 222 and 228 each have a first resistivity (i.e., resistance per unit length) ρ. The resistive portions 220, 224, 226, and 230 each have a second resistivity of about 1.25ρ, or 25% higher than the first resistivity. In some examples, the resistive portions 220, 224, 226, and 230 may each have a second resistivity between about 20% and about 25% higher than the first resistivity. As a result, the power dissipated per unit length adjacent the edge regions 210 and 212 is about 25% higher than the power dissipated per unit length adjacent the center region 214. However, the ratio of the resistivities of any of the resistive portions 220, 224, 226, and 230 to the either of the resistive portions 222 and 228 may be increased or decreased based on the length of the resistive wires 216 and 218 relative to the width of the ink drying area 112. The resistance values of the resistive portions 220-230 and, more generally, the resistive wires 216 and 218 depend on the desired temperature to which the print substrate 110 will be subjected to dry the ink.

The resistivities of the resistive portions 222 and 228 may be selected based on the desired temperature at which ink on the print substrate 110 is to be dried. The resistivity of the resistive portions 220, 224, 226, and 230 may be selected based on the desired temperature and temperature losses (e.g., observed, expected) associated with the edge regions 210 and 212 and/or based on the desired width of the resistive heating element 208. The resistivity ratio(s) may increase, for example, as the width of the resistive heating element 208 is decreased because the cooling effects of the surrounding structure of the printer 100 have a larger impact on the temperature in the edge regions 210 and 212. Conversely, the resistivity ratio(s) may decrease when, for example, the width of the resistive heating element 208 is increased, because the cooling effects of the surrounding structure of the printer 100 have a decreased effect and the edge regions 210 and 212 appear more like the center region 214.

The power source 202 provides electrical energy to the resistive heating element 208 (e.g., the resistive wires 216 and 218), which radiates heat (e.g., via infrared radiation) to the ink drying area 112. The controller 206 controls the switching elements 204*a* and 204*b* to control the flow of current to the resistive wires 216 and 218, thereby controlling the amount of infrared radiation generated by the resistive wires 216 and 218 and, thus, the temperature of the ink drying area 112. For example, the controller 206 may open one or both of the switching elements 204*a* and 204*b* to cut off the flow of energy, thereby cooling the ink drying area 112, or may close one or both of the switching elements 204*a* and 204*b* to enable the flow of energy, thereby increasing the temperature of the ink drying area 112. The controller 206 may increase or decrease the temperature in the ink drying area 112 to accommodate different inks, different print substrates 108 and 110, and/or changing ambient conditions around the printer 100. A temperature sensor 232 determines one or more temperature(s) in the ink drying area 112 (e.g., at a single point in the ink drying area 112, over the width of the ink drying area 112, etc.) and provides the temperature(s) to the controller 206.

Figure 3:
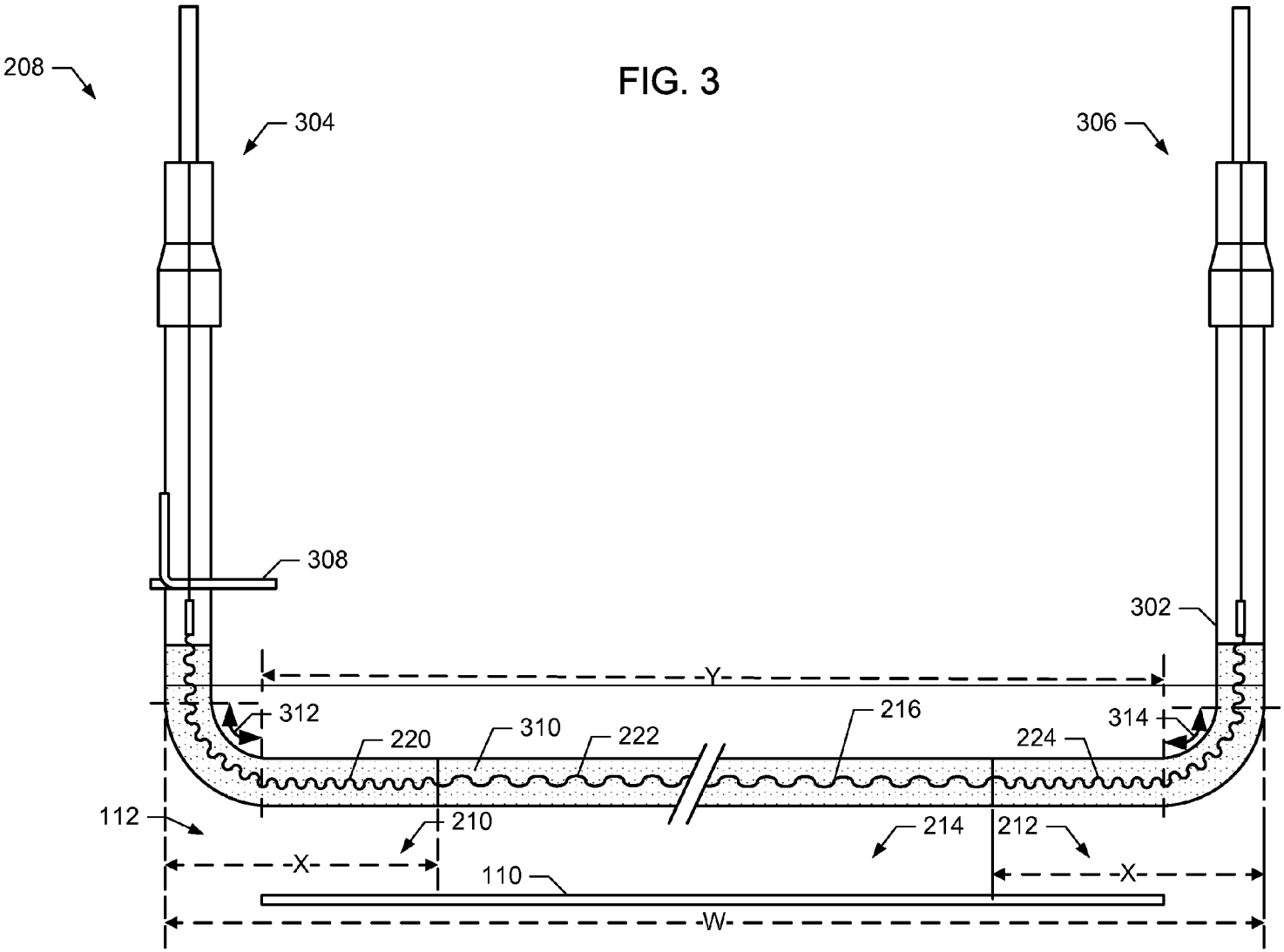
FIG. 3 is a side view of an example of a resistive element shown in the schematic diagram of FIG. 2 including a resistive wire and connecting assembly.

FIG. 3 is a side view of an example of the resistive heating element 208 shown in the schematic diagram of FIG. 2. The resistive heating element 208 includes an outer sheath 302, the resistive wires 216 and 218 (only the resistive wire 216 is shown), first and second connecting assemblies 304 and 306, a mounting bracket 308, and an insulation material 310. The example resistive heating element 208 is illustrated adjacent the print substrate 110 in the ink drying area 112.

The example outer sheath 302 is constructed using an American Iron and Steel Institute (AISI) Type 309 Stainless Steel and has a circular cross-section with an 8.5 millimeter (mm) diameter. However, in some other examples, the outer sheath 302 may be constructed using AISI Types 304-321 and/or other protective materials and/or may have a different cross section. The example insulation 310 is a magnesium oxide (MgO) powder, although other types of insulation materials may additionally or alternatively be used. The insulation 310 is used to fill the space between the resistive wires 316 and 318 and the outer sheath 302 to prevent short-circuiting the resistive wires 316 and 318 to the metallic outer sheath 302.

As described above, the example resistive wire 216 includes three resistive portions 220-224. The example resistive portions 220-224 may be constructed by forming the resistive wire 216 into a helix or coil shape having a first helical pitch (distance from center to center of the resistive wire 216 between adjacent turns). The example resistive portion 222 may then be stretched to increase the helical pitch (i.e., increase the distance per turn) of the resistive portion 222, thereby decreasing the resistivity and power dissipated per unit distance. After the resistive portion 222 is stretched, the example resistive portions 220 and 224 have a first helical pitch and the resistive portion 222 has a second, larger helical pitch. Accordingly, the resistive portions 220 and 224 have larger power dissipation densities than the resistive portion 222.

The example first and second connecting assemblies 304 and 306, which are described in more detail below, include electrically conductive connectors to couple the resistive wires 316 and 318 to the power source 202 and/or the switching elements 204*a* and 204*b*.

The example mounting bracket 308 may be attached to the printer 100 to attach the resistive heating element 208 to the printer 100 in a substantially fixed position adjacent the ink drying area 112. The mounting bracket 308 may be attached to the outer sheath 302 and/or the printer 100 using any attachment method(s), device(s), and/or combination of methods(s) and/or device(s), including but not limited to welding, soldering, brazing, and/or fastening. The example resistive heating element 208 includes approximately 90-degree bends 312 and 314, having bend radii of about 15 mm, to position the resistive portions 220-230 adjacent the ink drying area 112. The bends 312 and 314 may be formed to have any desired angle and/or radius, but may result in the printer 100 having a larger lateral footprint to accommodate a wider footprint of the resistive heating element 208.

The example resistive heating element 208 has a width W of about 1100 mm. The example portions of the resistive heating element 208 that are adjacent the edge regions 210 and 212 of the ink drying area 112 each have widths X of about 68 mm. In the example, a straight portion of the resistive heating element 208 (the portion of the resistive element between the bends 312 and 314) has a width Y about equal to the upper width of the print substrate 110. Thus, the width W of the example resistive heating element 208 is about 18 mm longer on each side than the width of the print substrate 110 (e.g., 36 mm longer total). Accordingly, to obtain the desired temperature at the surface of the print substrate 110, each of the resistive portions 220, 224, 226, and 230 has a resistance between about 81.16 ohms (Ω) and about 89.7 Ω, and each of the resistive portions 222 and 228 has a resistance between about 61.26 Ω and about 67.7 Ω. The example power source 202 of FIG. 2 provides a potential of about 254 Volts. However, any or all of the above example specifications may be modified based on the ink, the width of the resistive heating element 208, the type of the print substrate 110, the print speed, and/or other requirements of a particular application. For example, the width W of the example resistive heating element 208 may be less than 36 mm or longer than 36 mm.

Figure 4:
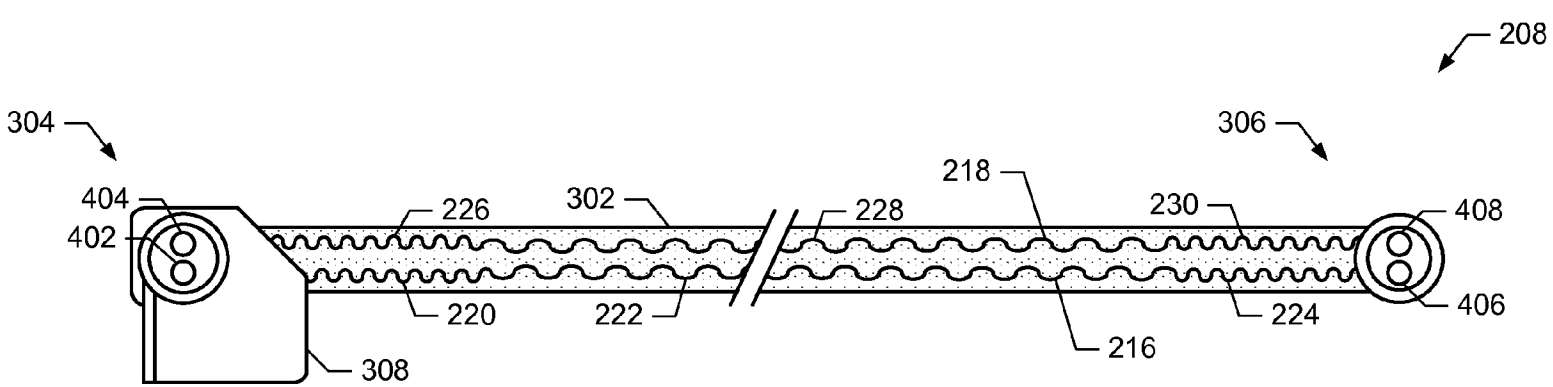
FIG. 4 is another view of the example resistive element of FIG. 3.

FIG. 4 is another view of the example resistive heating element 208 of FIG. 3. As described above, the resistive heating element 208 includes the resistive wires 216 and 218, the outer sheath 302, the connecting assemblies 304 and 306, and the mounting bracket 308. While the resistive wires 216 and 218 are shown side-by-side in FIG. 4, the resistive wires 216 and 218 may be arranged within the outer sheath 302 in any desired manner (e.g., intertwined, side-by-side, top-bottom, etc.). However, the resistive wires 216 and 218 are separated by space and/or by the insulation 310 to ensure that the desired control is exercised over the heating of the resistive wires 216 and 218 via the switching elements 204*a* and 204*b*.

The example connecting assembly 304 includes connecting pins 402 and 404 to electrically couple respective ones of the resistive wires 316 and 318 to a power source (e.g., the power source 202 of FIG. 2) and/or a controller (e.g., the switching elements 204*a* and 204*b* and/or the controller 206 of FIG. 2). Similarly, the connecting assembly 306 includes connecting pins 406 and 408 to electrically couple respective ones of the resistive wires 316 and 318 to the power source and/or the controller 206 (FIG. 2). Thus, the connecting pins 402 and 406 may complete a circuit between the power source 202, the switching element 204*a*, and the resistive wire 216 and the connecting pins 404 and 408 may complete a circuit between the power source 202, the switching element 204*b*, and the resistive wire 218.

Figure 5:
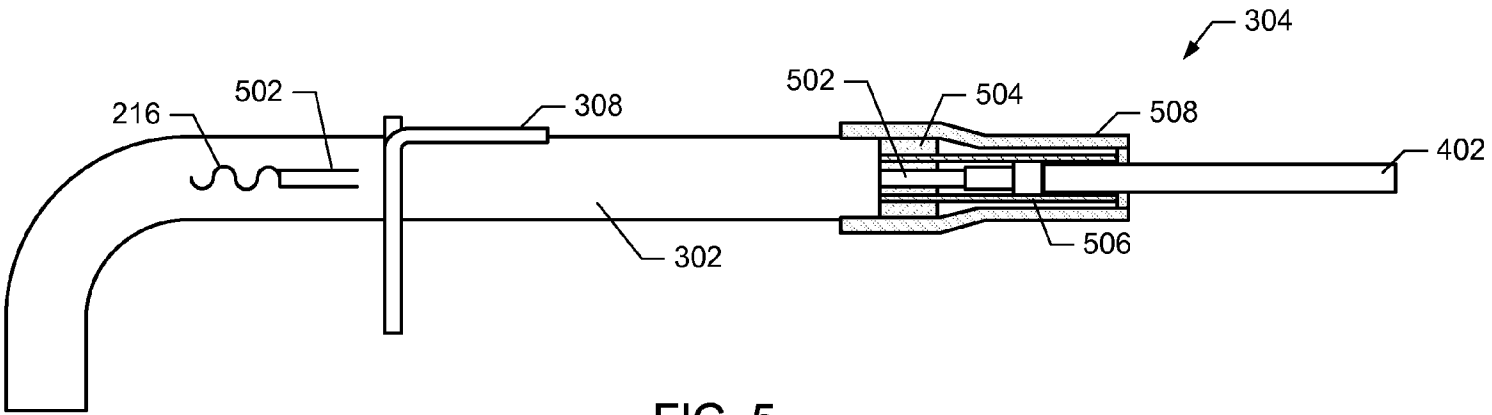
FIG. 5 is a cutaway view of the example connecting assembly of FIG.3.

FIG. 5 is a cutaway view of the example connecting assembly 304 of FIG. 3. As mentioned above, the connecting assembly 304 connects the resistive wire 216 to a power source and/or a controller. The example connecting assembly 304 includes the connecting pins 402 and 404 (the connecting pin 404 is obscured in FIG. 5), a connecting wire 502, a sealant 504, an inner sheath 506, and an outer cover 508. While the example view of FIG. 5 shows one connecting wire 502 and one inner sheath 506, an additional connecting wire and an additional inner sheath are also included in the connecting assembly 304 but are obscured by the illustrated connecting wire 502 and the inner sheath 506.

The connecting wire 502 is electrically coupled to the resistive wire 216. The example connecting wire 502 is constructed using American Wire Gauge (AWG) 16 gauge, Underwriters' Laboratories (UL) Style 5288 wire. The sealant 504 seals the outer sheath 302 to, for example, reduce or prevent the escape of the insulation 310 from the outer sheath 302. The example sealant 504 is RTV116 silicone sealant.

The inner sheath 506 is a non-conductive sheath that is wrapped around the connecting wire 502 to, for example, prevent short-circuiting the connecting wire 502 to other electrically conductive components (e.g., the connecting wire connected to the connecting pin 404 of FIG. 4). The example inner sheath 506 is a fiberglass sheath including silicone rubber. The outer cover 508 protects the connecting wire 502, the sealant 504, the inner sheath 506, and respective portions of the connecting pins 402 and 404 from damage. The example outer cover 508 is a SRFR round silicone rubber heat shrink.

While some example materials and geometries are provided for the example outer sheath 302, the insulation 310, the connecting wire 502, the sealant 504, the inner sheath 506, and the outer cover 508, the examples are not limited to the example materials. To the contrary, the examples may be modified to use alternative materials and/or geometries.

Figure 6:
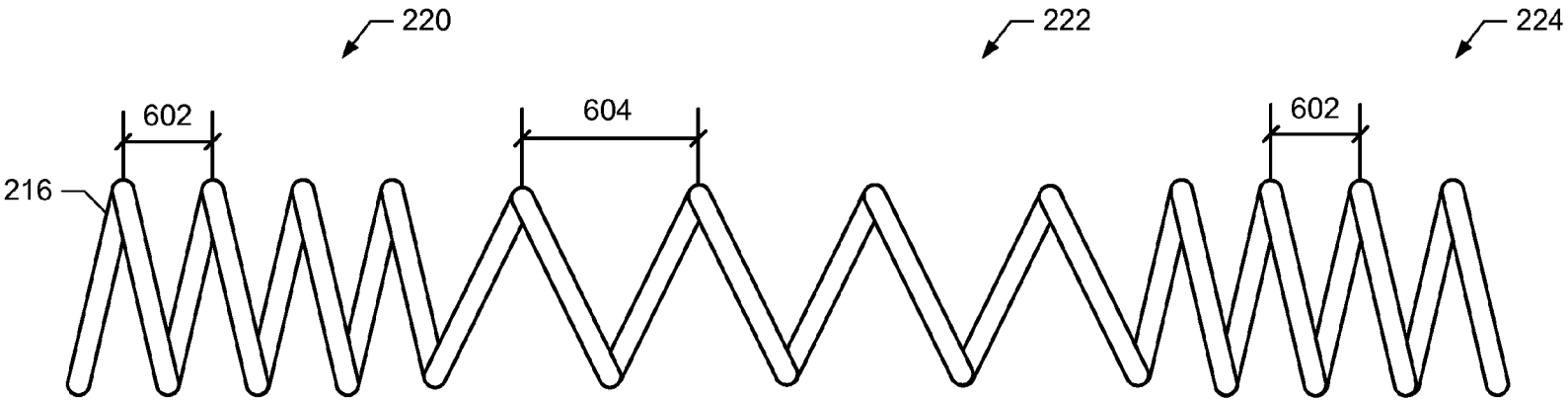
FIG. 6 illustrates the example resistive wire of FIG. 3 having multiple helical pitches.

FIG. 6 illustrates the example resistive wire 216 of FIG. 3 having multiple helical pitches 602 and 604. The resistive portions 220 and 224 have a first pitch 602 and the resistive portion 222 has a second pitch 604. The differences between the example pitches 602 and 604 are not to scale and are exaggerated for clarity. However, in accordance with the example resistivities described above, the helical pitch 604 is larger than the helical pitch 602 by a factor of about 1.25. Thus, the example resistive wire 216 may have a substantially uniform resistivity per unit length of material and still have different resistivities between the different resistive portions 220, 222, and 224.

As noted at the beginning of this Description, the examples shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. An ink drying apparatus, comprising a resistive heating element having a first power dissipation density adjacent to a center region of a print media travel path and a second power dissipation density adjacent to an edge region of the print media travel path, an axis of a portion of the resistive heating element comprising a bend in a direction at a fixed, non-zero angle away from the print media travel path when installed adjacent the print media travel path, the resistive heating element having a first coil pitch to provide the first power dissipation density, the resistive heating element having a second coil pitch to provide the second power dissipation density at least through the bend, the first power density being different than the second power density, the bend being adjacent the edge region, and the resistive heating element to generate a substantially constant temperature across the center region and the edge region.

2. An ink drying apparatus as defined in claim 1, wherein the first coil pitch is greater than the second coil pitch.

3. An ink drying apparatus as defined in claim 1, wherein:

the edge region comprises a first edge region and a second edge region opposite the first edge region across the center region; and the resistive element has the second power dissipation density adjacent the second edge region of the print media travel path opposite the first edge region; or the resistive element has a third power dissipation density adjacent to the second edge region, wherein the third power dissipation density is not equal to either the first or the second power dissipation densities.

4. An ink drying apparatus as defined in claim 1, wherein the second power dissipation density is higher than the first power dissipation density.

5. An ink drying apparatus as defined in claim 4, wherein the second power dissipation density is between 20%-25% higher than the first power dissipation density.

6. An ink drying apparatus as defined in claim 1, wherein the resistive element generates a first substantially constant temperature across the center region and generates a second substantially constant temperature over the edge region.

7. An ink drying apparatus as defined in claim 1, wherein the resistive element is made of a material having a substantially uniform resistivity.

8. An ink drying apparatus as defined in claim 1, wherein the resistive element generates infrared radiation to dry ink in the center region and the edge region.

9. An ink drying apparatus as defined in claim 1, wherein the resistive heating element has a width substantially equal to a width of print media traveling in the print media travel path.

10. An ink drying apparatus as defined in claim 1, further comprising a sheath enveloping the resistive heating element, the sheath having a bend and the resistive heating element having the second power dissipation density within the bend in the sheath.

11. An ink drying apparatus as defined in claim 1, wherein a second portion of the resistive heating element adjacent to the center region extends straight over the print media travel path.

12. An ink drying apparatus as defined in claim 1, wherein a width of a portion of the resistive heating element adjacent the edge region is about 68 millimeters.

13. A method to dry ink, comprising:

applying ink to print media traveling through a first location in a first direction;

moving the print media to a second location after the first location in the first direction, the second location having a center region and first and second edge regions;

heating a first portion of a resistive element adjacent the center region, the first portion of the resistive heating element having a first coil pitch to provide a first power dissipation density;

heating a second portion of the resistive element adjacent the first edge region, the second portion of the resistive heating element having a second coil pitch to provide a second power dissipation density greater than the first power dissipation density, an axis of the second portion of the resistive heating element comprising a first bend in a direction at a fixed, non-zero angle away from a path of the print media in the first location, the resistive heating element having the second power dissipation density at least through the first bend; and heating a third portion of the resistive element adjacent the second edge region at the second power dissipation density or a third power dissipation density, the third portion of the resistive heating element comprising a second bend and the resistive element to generate a substantially constant temperature across the center region, the first edge region, and the second edge region.

14. A method as defined in claim 13, wherein the second power dissipation density and the third power dissipation density are between 20%-25% higher than the first power dissipation density.

15. An ink drying apparatus, comprising:

a resistive heating device disposed proximate a large format printer media travel path having a center region, a first edge region, and a second edge region, the resistive heating device comprising:

a coiled resistive element having:

a first portion adjacent the first edge region and having a first coil density, an axis of the first portion of the coiled resistive element comprising a first bend in a direction at a fixed, non-zero angle away from the media travel path when installed adjacent the print media travel path, the coiled resistive element having the first coil density through the first bend;

a second portion adjacent the center region and having a second coil density less than the first coil density; and a third portion adjacent the second edge region and having the first coil density, the third portion of the coiled resistive element comprising a second bend, the coiled resistive element to generate a substantially constant temperature across the center region and the first and second edge regions.

16. An ink drying apparatus as defined in claim 15, wherein the first coil density is between about 20% and about 25% higher than the second coil density.

17. An ink drying apparatus as defined in claim 15, wherein the first, second, and third portions of the coiled resistive element have a substantially constant resistivity.

18. An ink drying apparatus as defined in claim 15, wherein the resistive heating device further comprises a second coiled resistive element adjacent to the first coiled resistive element, the second coiled resistive element having:

a fourth portion adjacent the first edge region and having the first coil density or a third coil density;

a fifth portion adjacent the center region and having the second coil density or a fourth coil density less than the third coil density; and a sixth portion adjacent the second edge region and having the first coil density or the third coil density.

* * * * *